US010383190B2

(12) United States Patent
Hegde et al.

(10) Patent No.: US 10,383,190 B2
(45) Date of Patent: Aug. 13, 2019

(54) SYSTEMS AND METHODS TO CONTROL LIGHT COLOR TEMPERATURE DURING DIMMING

(71) Applicant: LEDVANCE LLC, Wilmington, MA (US)

(72) Inventors: Ravidasa Hegde, Andover, MA (US); Khounthavy Phasay, Falls Church, VA (US)

(73) Assignee: LEDVANCE LLC, Wilmington, MA (US)

( * ) Notice: Subject to any disclaimer, the term of this patent is extended or adjusted under 35 U.S.C. 154(b) by 0 days.

(21) Appl. No.: 15/550,158

(22) PCT Filed: Feb. 5, 2016

(86) PCT No.: PCT/US2016/016681

§ 371 (c)(1),
(2) Date: Aug. 10, 2017

(87) PCT Pub. No.: WO2016/127014

PCT Pub. Date: Aug. 11, 2016

(65) Prior Publication Data

US 2018/0020521 A1 Jan. 18, 2018

Related U.S. Application Data

(60) Provisional application No. 62/113,256, filed on Feb. 6, 2015.

(51) Int. Cl.
*H05B 33/08* (2006.01)
*H05B 37/02* (2006.01)

(52) U.S. Cl.
CPC ..... *H05B 33/0866* (2013.01); *H05B 33/0848* (2013.01); *H05B 37/02* (2013.01); *H05B 33/0815* (2013.01)

(58) Field of Classification Search
CPC ..... H05B 33/0848; H05B 37/02
See application file for complete search history.

(56) References Cited

U.S. PATENT DOCUMENTS 8,456,109 B1 * 6/2013 Wray ..... H05B 33/0824 315/209 R
2008/0224631 A1 * 9/2008 Melanson ..... H05B 33/0818 315/291

(Continued)

FOREIGN PATENT DOCUMENTS

GB 2421367 A 6/2006

OTHER PUBLICATIONS

Texas Instruments, LM3414/HV 1-A, 60-W Common Anode-Capable Constant Current Buck LED Driver Requires No External Current Sensing Resistor (Year: 2010).*

(Continued)

*Primary Examiner* — Dedei K Hammond
*Assistant Examiner* — Raymond R Chai
(74) *Attorney, Agent, or Firm* — Tutunjian & Bitetto, PC

(57) ABSTRACT

Systems to control light color temperature during dimming are disclosed. A power supply drives a load include a first light source (e.g., to emit a first color of light) and a second light source (e.g., to emit a second color of light). The power supply includes a front end circuit, a converter circuit, and a load current control circuit. The front end circuit receives an input voltage from a dimmer and generates a direct current (DC) voltage based on the received input voltage. The converter circuit generates a first voltage to drive the first light source and a second voltage to drive the second light source. The load current control circuit controls the current flowing through the second light source based on a light control setting configured in the dimmer.

14 Claims, 9 Drawing Sheets

(56) References Cited

U.S. PATENT DOCUMENTS

| | | | | |
|---|---|---|---|---|
| 2008/0224636 | A1* | 9/2008 | Melanson | H05B 33/0815 315/307 |
| 2010/0002480 | A1* | 1/2010 | Huynh | H02M 3/335 363/90 |
| 2011/0080115 | A1* | 4/2011 | Ge | H05B 33/0812 315/294 |
| 2012/0242242 | A1* | 9/2012 | Linz | H05B 33/0815 315/210 |
| 2013/0293151 | A1* | 11/2013 | Puvanakijjakorn | H05B 33/0815 315/297 |
| 2014/0070710 | A1* | 3/2014 | Harris | H05B 33/0809 315/185 R |
| 2014/0091723 | A1* | 4/2014 | Kuo | H05B 33/0818 315/200 R |
| 2014/0252967 | A1* | 9/2014 | van de Ven | H05B 33/0863 315/188 |
| 2015/0137689 | A1* | 5/2015 | Hu | H05B 33/0827 315/192 |
| 2016/0088697 | A1* | 3/2016 | Yan | H05B 33/0818 315/205 |

OTHER PUBLICATIONS

PCT/US2016/016681, search report dated Apr. 28, 2016.

* cited by examiner

SYSTEMS AND METHODS TO CONTROL LIGHT COLOR TEMPERATURE DURING DIMMING

CROSS-REFERENCE TO RELATED APPLICATIONS

The present application is a national stage application of, and claims priority to, International Application PCT/US16/16681, filed Feb. 5, 2016 which claims priority to, U.S. provisional patent application 62/113,256 entitled "Two Channel Driver for CCT Dimming" and filed on Feb. 6, 2015. The contents of the above-identified applications are incorporated by reference, in entirety, herein.

TECHNICAL FIELD

The present invention relates to electronics, and more specifically, to controlling solid state light sources during dimming.

BACKGROUND

At least one area of concentration for electronic technology development is designing products that operate with increased efficiency, reliability, etc. over longer periods of time. One area of development where this trend is highly visible is lighting. Conventional incandescent lamps are quickly being replaced by more efficient light sources, such as but not limited to compact fluorescent lamps (CFLs) and devices including one or more solid state light sources (such as but not limited to light emitting diodes (LEDs), organic LEDs (OLEDs), polymer LEDs (PLEDs), and so on). Such light sources typically perform with higher efficiency than conventional incandescent lamps and may last longer as well. As a result, many applications are transitioning to these new lighting technologies.

SUMMARY

Despite the apparent benefits, more efficient lighting technologies do suffer from some drawbacks. Consumers are accustomed to the operation and behavior of conventional incandescent lamps, which have widely used for well over one hundred years. Such conventional incandescent lamps generate light with a certain intensity, color, color temperature, etc. based on the type of lamp, and consumers may desire or expect that more efficient lighting products behave in a similar fashion. However, more efficient lighting technologies, such as solid state light sources, do not typically behave similarly to conventional lighting technologies. For example, the quality of light emitted by one or more solid state light sources may differ in intensity, focus, color spectrum (e.g., as determined on a kelvin light color temperature scale), etc. from their well-known conventional cousins. These differences are highlighted further when considering dimming technology. Dimming technology for incandescent lamps was designed to operate with incandescent lamps. As some consumers have discovered to their chagrin when they replace conventional incandescent lamps with solid state light source-based lighting devices, the dimmers that used to result in dimmed lighting do not necessarily do so with the new devices, or do not result in dimmed lighting similar to that of conventional incandescent light sources. For example, the characteristics of light generated by an incandescent lamp may vary substantially when dimming from full output to half output, but solid state light source-based lighting devices may not exhibit the same changes over the same dimming range.

Embodiments provide systems and methods to control light color temperature during dimming of solid state light sources. A power supply is configured to drive a load including a first light source (e.g., at least one LED to emit light of a first color temperature) and a second light source (e.g., at least one LED to emit light of a second color temperature). The power supply includes a front end circuit, a converter circuit, and a load current control circuit. The front end circuit receives an input voltage from a dimmer and generates a direct current (DC) voltage based on the input voltage. The converter circuit generates a first voltage to drive the first light source and a second voltage to drive the second light source. In some embodiments, the converter circuit generates a sense voltage that may correspond to a current flowing through the first light source. When the dimmer is a phase-cut dimmer, the current flowing through the first light source may be an indicator of the current phase angle of the dimmer. The load current control circuit controls the current flowing through the second light source based on a light control setting configured in the dimmer (e.g., using the sense voltage). During operation, the power supply causes the first and second light sources to operate collaboratively, so as to produce a light emission behavior that is similar to an incandescent light source controlled by a dimmer configured at the control setting.

In an embodiment, there is provided a system. The system includes: a load including a first light source and a second light source; and a power supply to drive the load, the power supply including: a front end circuit to generate a direct current voltage based on an input voltage received from a dimmer; a converter circuit to generate a first voltage to drive the first light source and a second voltage to drive the second light source based on the direct current voltage; and a load current control circuit to control a current flowing through the second light source based on a light control setting configured in the dimmer.

In a related embodiment, the converter circuit may include a direct current voltage to direct current voltage converter based on a continuous-conduction mode flyback topology. In another related embodiment, the first light source may include a solid state light source that emits light at a first color temperature and the second light source may include a solid state light source that emits light at a second color temperature. In a further related embodiment, the first color temperature may have a higher correlated color temperature than the second color temperature. In another further related embodiment, the load current control circuit may be configured to control the current flowing through the second light source to cause the first light source and the second light source to operate collaboratively, so as to produce light similar to light emitted by an incandescent light source controlled by a dimmer configured at the light control setting. In yet another further related embodiment, the load current control circuit may be configured to control the current flowing through the second light source based on a sense voltage proportional to a current flowing through the first light source. In a further related embodiment, the dimmer may be a phase-cut dimmer, and the sense voltage may represent the phase angle of the phase-cut dimmer. In a further related embodiment, the load current control circuit may include a current regulator circuit to control the current flowing through the second light source, the current regulator circuit may include: an operational amplifier; a first resistor coupled to an output of the operational amplifier; a transistor having a gate coupled to the first resistor and a drain coupled to an output of the second light source; a second resistor coupled between a source of the transistor and an input to the operational amplifier; a current sense resistor coupled between the source of the transistor and a negative terminal of the first light source; and a capacitor coupled between the first resistor and the sense resistor. In a further related embodiment, the operational amplifier may be configured to receive a reference voltage corresponding to the amount of current to be allowed to flow through the second light source.

In another embodiment, there is provided a power supply The power supply includes: a front end circuit to generate a direct current voltage based on an input voltage; a converter circuit to utilize the direct current voltage to generate a first voltage to drive a first light source, a second voltage to drive a second light source, and a sense voltage proportional to a current flowing through the first light source; and a load current control circuit to control the current flowing through the second light source based at least on the sense voltage.

In a related embodiment, the input voltage may be received in the front end circuit from a phase-cut dimmer, and the sense voltage may represent the phase angle of the phase-cut dimmer. In a further related embodiment, the load current control circuit may include a current regulator circuit to control the current flowing through the second light source, the current regulator circuit may include: an operational amplifier; a first resistor coupled to an output of the operational amplifier; a transistor having a gate coupled to the first resistor and a drain coupled to an output of the second light source; a second resistor coupled between a source of the transistor and an input to the operational amplifier; a current sense resistor coupled between the source of the transistor and a negative terminal of the first light source; and a capacitor coupled between the first resistor and the sense resistor. In a further related embodiment, the operational amplifier may be configured to receive a reference voltage corresponding to the amount of current to be allowed to flow through the second light source.

In another embodiment, there is provided a method to control light color temperature for at least two light sources. The method includes: receiving an input voltage from a dimmer; converting the input voltage to a direct current voltage; generating a first voltage to drive a first light source and a second voltage to drive a second light source based on the direct current voltage; and controlling a current flowing through the second light source based on a light control setting configured in the dimmer.

In a related embodiment, the dimmer may be a phase-cut dimmer and the control setting may be a phase angle of the phase-cut dimmer. In a further related embodiment, the method may further include: receiving a sense voltage proportional to a current flowing through the first light source; and determining the phase angle of the phase-cut dimmer based on the current flowing through the first light source.

In another related embodiment, controlling a current flowing through the second light source may include utilizing an operational amplifier configured to receive a reference voltage corresponding to the amount of current to be allowed to flow through the second light source to control a transistor to control the current flowing through the second light source. In yet another related embodiment, the method may further include: causing the first light source and the second light source to operate collaboratively, so as to produce light similar to light emitted by an incandescent light source controlled by a dimmer configured at the light control setting.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
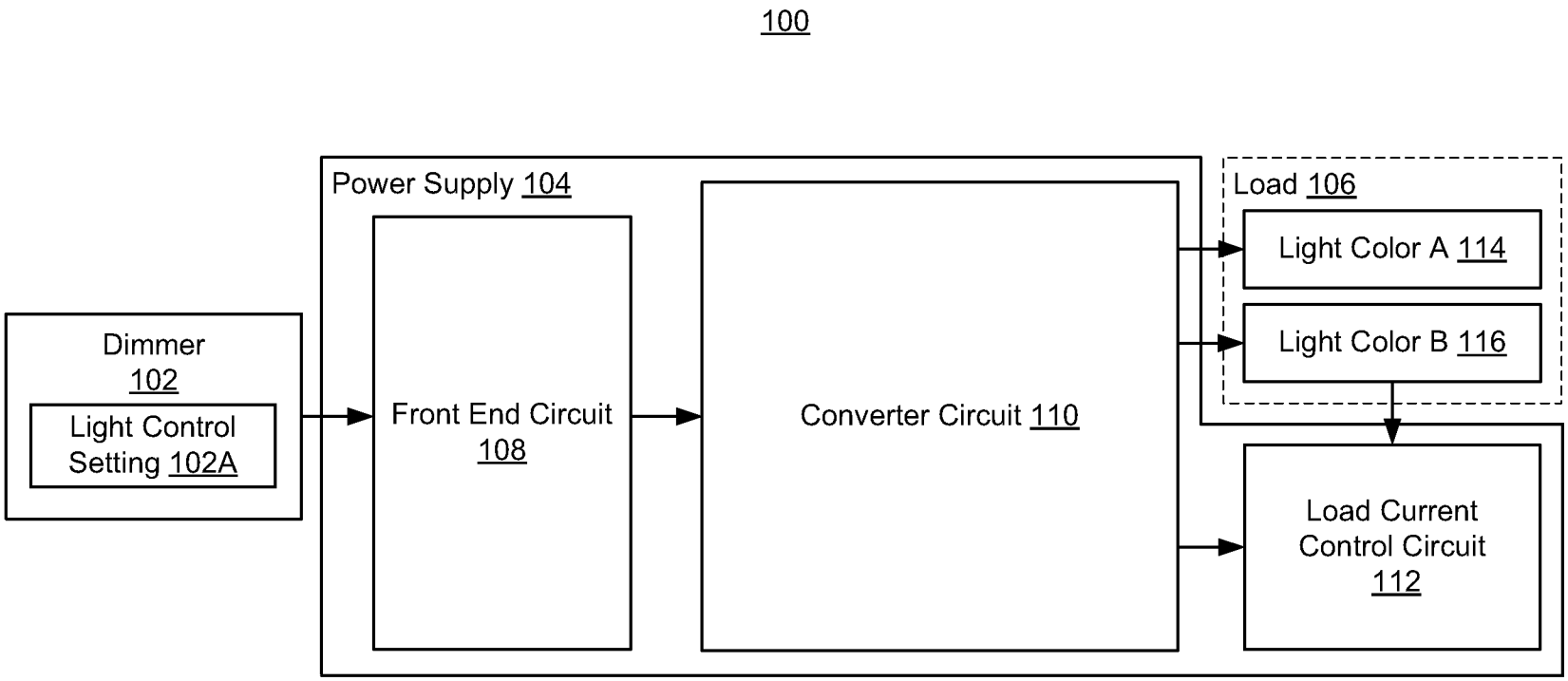
FIG. 1 illustrates a block diagram of a system according to embodiments disclosed herein.

FIG. 1 illustrates a block diagram of a system 100 that controls light color temperature during dimming. The system 100 includes a dimmer 102, a power supply 104, and a load 106. In some embodiments, the dimmer 102 includes a phase-cut dimmer circuit 102. A phase-cut dimmer circuit 102 may reduce the amplitude of an alternating current (AC) signal to zero for some portion of each power line half cycle. This causes a light source to turn on and off many times per second, but overall (at least in the case of conventional incandescent lamps), the light source appears to be dimmer due to the filament smoothing out the on and off transitions. The power supply 104 includes, in some embodiments, a front end circuit 108, a converter circuit 110, and a load current control circuit 112. The load 106 includes Light Color A 114 and Light Color B 116. The Light Color A 114 may, and in some embodiments does, comprise at least one solid state light source that emits light of a first color, and the Light Color B 116 may, and in some embodiments does, comprise at least one solid state light source that emits light of a second color. In some embodiments, the light of the first color has a higher color correlated temperature (CCT, e.g., emitting bright white light at about 3000K) than the light of the second color (e.g., emitting amber or "sunset" light at a CCT of about 2000K).

The power supply 104 receives an input voltage from the dimmer 102 via the front end circuit 108. Given that the dimmer 102 in some embodiments includes a phase-cut dimming circuit 102, the input voltage in such embodiments is a phase-cut AC voltage. The front end circuit 108 converts the (phase-cut) AC input voltage into a DC voltage, and provides the DC voltage to the converter circuit 110. The converter circuit 110 drives the load 106. More specifically, the converter circuit 110 generates a first voltage to drive the Light Color A 114 and a second voltage to drive the Light Color B 116. While the Light Color A 114 emits light based principally on the first voltage, the load current control circuit 112 controls the operation of the Light Color B 116 by controlling the current flowing through the Light Color B 116. In this manner, the behavior of the Light Color A 114 and the Light Color B 116 may vary depending on, for example, a light control setting 102A configured in the dimmer 102.

At least one objective that may be achieved by controlling the operation of the Light Color A 114 separately from the Light Color B 116 is that the light emission behavior of an incandescent light source controlled by a dimmer configured at the light control setting may be replicated. For example, when the dimmer 102 is configured to allow the most light (e.g., so that the AC voltage is experiencing minimal phase cut), the light emission of load 106 may be primarily from the Light Color A 114. As the dimmer 102 is reconfigured to dim the light emission of load 106, the contribution of the Light Color B 116 may be increased to change the intensity and color of the emitted light to resemble that of a dimmed incandescent light source. Operating in this manner, an incandescent light source is able to be replaced with an LED-driven light source, and a user of the LED-drive light source may experience performance similar to the incandescent light source while realizing the substantial benefits of the LED-driven light source such as, for example, higher efficiency, lower heat output, longer lifetime, etc.

Figure 2:
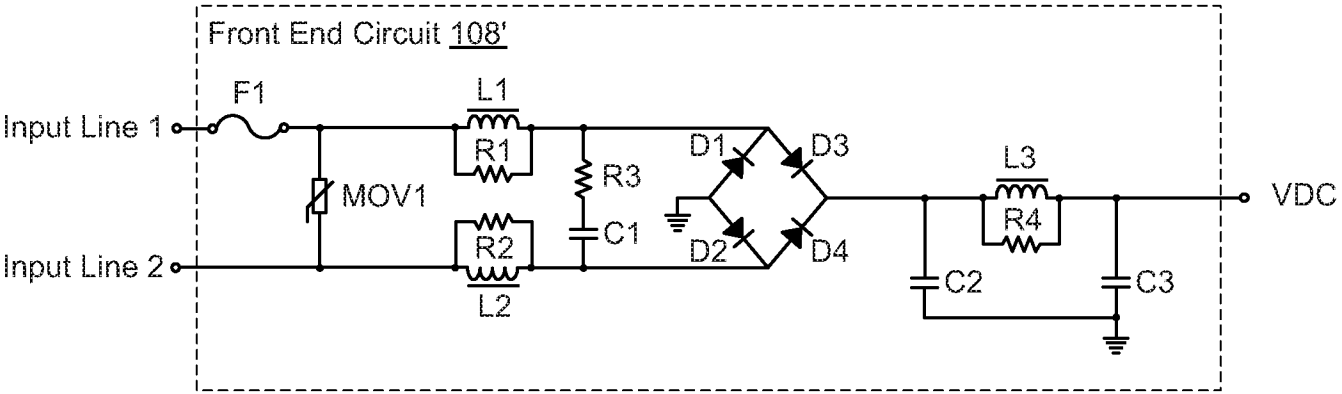
FIG. 2 illustrates a circuit diagram of a front end circuit according to embodiments disclosed herein.

FIG. 2 illustrates a circuit diagram of a front end circuit 108'. In some embodiments, the front end circuit 108' is configured to receive an AC input voltage from a dimmer, such as but not limited to the dimmer 102 of FIG. 1. In such embodiments, among others, the front end circuit 108' includes an energized input line 1 and a neutral input line 2. In some embodiments, the front end circuit 108' is configured to receive other line configurations of AC input voltages or even DC input voltages. The input voltage is supplied to the front end circuit 108' via a fuse F1 coupled to the energized input line 1 and a metal oxide varistor MOV1 coupled across the energized input line 1 and the neutral input line 2. The fuse F1, in some embodiments, protects against input over current in the event of faults due to component failures. The metal oxide varistor MOV1, in some embodiments, protects at least the front end circuit 108' from failure against line transients. The front end circuit 108' also includes an inductor L1 and a resistor R1 in parallel across the inductor L1. The inductor L1 is connected to the fuse F1 and the metal oxide varistor MOV1, and to a resistor R3. The resistor R3 is connected in series to a capacitor C1, and to a full-wave rectifier including diodes D1, D2, D3, and D4. An inductor L2 is connected to the metal oxide varistor MOV1 and the neutral input line 2, and to the capacitor C1. A resistor R2 is in parallel across the inductor L2. An inductor L4 is connected to the full-wave rectifier including the diodes D1, D2, D3, and D4, as well as to a capacitor C2 and a capacitor C3. The capacitor C2 and the capacitor C3 are both connected to ground. The inductor L3 and the capacitor C3 are also connected to an output VDC of the front end circuit 108'. A resistor R4 is in parallel across the inductor L3. The inductor L1, the inductor L2, the inductor L3, the resistor R1, the resistor R2, the resistor R4, the capacitor C1, the capacitor C2, and the capacitor C3 are configured so as to form an electromagnetic interference (EMI) filter to limit conducted emissions from a power supply circuit that includes the front end circuit 108', such as but not limited to the power supply circuit 104 of FIG. 1. This limitation on conducted emissions is to, for example, ensure compliance with FCC part 15 class B EMI limits. The resistor R3 and the capacitor C1 form an RC network to dampen ringing that may cause the input current to drop too low (e.g., close to zero) which, when using leading-edge triac dimmers, may cause the triac to turn off and light output to flicker. The capacitor C2 and the capacitor C3 may be arranged in parallel coupled between the output VDC of the front end circuit 108' and ground on either side of the inductor L3 and the resistor R4. The output VDC produces a DC output voltage.

Figure 3:
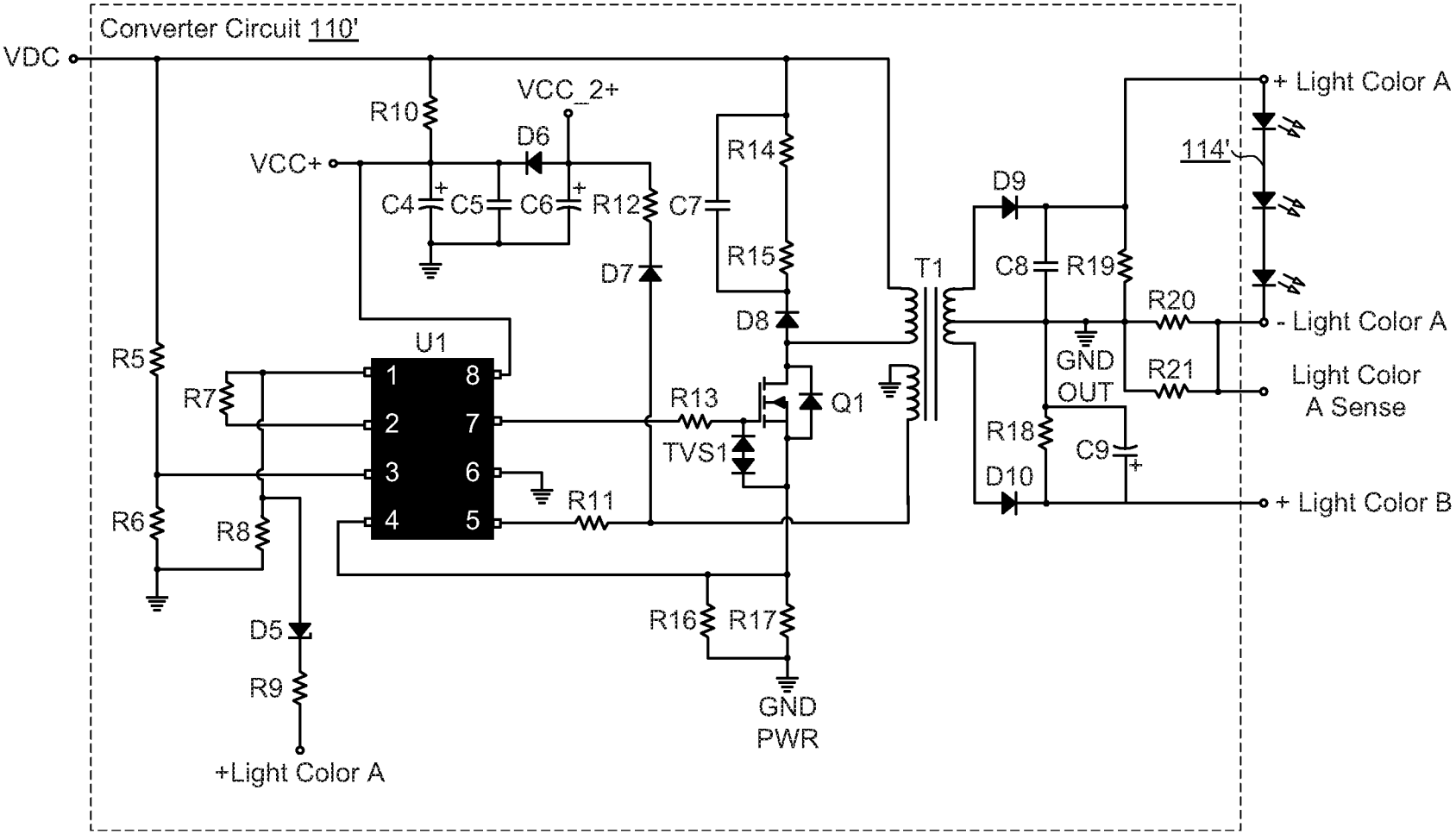
FIG. 3 illustrates a circuit diagram of a converter circuit according to embodiments disclosed herein.

FIG. 3 illustrates a circuit diagram of a converter circuit 110', which is based on a DC voltage to DC voltage (DC/DC) converter utilizing a critical conduction mode (CCM) power factor correction (PFC) flyback architecture. However, other DC/DC converter technologies may be, and are, employed in some embodiments, such as but not limited to buck, boost, buck-boost, Ćuk, inverting, single-ended primary-inductor converter (SEPIC), etc.

The converter circuit 110' is connected to the output VDC of the front end circuit 108' of FIG. 2. A resistor R5 and a resistor R6 are arranged as a voltage divider between the output VDC of the front end circuit 108' of FIG. 2 and ground to generate a reduced voltage provided to a pin 3 of a controller U1 (e.g., in the instance of an L6562, the main multiplier input) as a reference so that the peak input currents may be made to follow the envelope of input voltage. A resistor R7 is coupled between a pin 1 and a pin 2 of the controller U1 (e.g., in the instance of an L6562, the inverting input and error amplifier output, respectively) to form an error amplifier. A resistor R9 and a diode D5 are coupled in series between the pin 1 and an output +Light Color A to, for example, provide overvoltage protection of the driver in the event of open circuit on driver outputs. For example, the diode D5 in some embodiments is a Zener diode, and its value may determine the output voltage threshold when the overvoltage protection is triggered.

A resistor R16 and a resistor R17 are coupled in parallel between a pin 4 of the controller U1 (e.g., in the instance of an L6562, CS) and ground to act as current sense resistors, which provide the feedback of the current though a transistor Q1, which in some embodiments, is an n-channel MOSFET, and is also referred to herein as a flyback transistor Q1 (e.g., including a body diode), so that the peak current is controllable. A transient voltage suppressor TVS1 protects at least transistor Q1 from transient voltages. In some embodiments, the transient voltage suppressor TVS1 is incorporated within the flyback transistor Q1. A pin 6 of the controller U1 (e.g., in the instance of an L6562, GND) is be coupled to ground.

A transformer T1 includes one primary winding and at least a first output winding, a second output winding, and a third output winding. The first output winding and the second output winding are used to generate two DC outputs for a load, which includes a Light Color A 114' (shown in FIG. 3) and a Light Color B 116' (shown in FIG. 4), while the third output winding is used to generate a bias voltage to power electronics located in a power supply circuit including the converter circuit 110', such as but not limited to a controller IC, operational amplifiers, reference generators, and so on. The third output winding (e.g., the bias winding) is coupled to a pin 5 of the controller U1 (e.g., in the instance of an L6562, a zero crossing detector (ZCD)) through a resistor R11, causing the transistor Q1 to turn on based on a negative-edge going trigger. A cathode of a diode D7 is also connected to the resistor R11 and the bias winding of the transformer T1. An anode of the diode D7 is connected to a resistor R12, which is connected to a capacitor C6. This configuration provides operational voltage to a load current control circuit, such as the load current control circuit 112', via an output VCC_2+. The capacitor C6, the resistor R12, and the output VCC_2+ are all also connected to a cathode of a diode D6. The capacitor C6 is also connected to a capacitor C5, which is connected to an anode of the diode D6. A capacitor C4 is in parallel with the capacitor C5 and is connected to ground. The diode D6, the capacitor C4, and the capacitor C5 are configured to provide power needed for the controller U1 to operate. The capacitor C4 is also connected to a resistor R10, which is connected to the output VDC of the front end circuit 108' of FIG. 2. The resistor R10 and the capacitor C4 form a startup circuit to kick start the converter circuit 110' by, for example, supplying operational power to a pin 8 (e.g., in the instance of an L6562, VCC) of the controller U1 during startup, until the generation of operational power by the bias winding of the converter circuit 110' stabilizes. A resistor R14, a resistor R15, and a diode D8 are coupled in series between the output VDC of the front end circuit 108' of FIG. 2 and a drain of the transistor Q1. A capacitor C7 is coupled in parallel across the resistor R14 and the resistor R15. This acts as a snubber circuit to limit spikes caused by the leakage flux in the transformer T1 to be well within the max drain-to-source voltage (Vds) rating of the transistor Q1. A gate of the transistor Q1 is coupled to a pin 7 of the controller U1 (e.g., in the instance of an L6562, the gate driver output) through a resistor R13. The controller U1 drives the transistor Q1 based on, for example, the input voltage, phase angle and the load connected to an output of the converter circuit 110'.

During operation of the converter circuit 110', energy is stored in the primary winding of the transformer T1 during a switch ON period of the switching cycle and transferred to its three output windings during a switch OFF period of the switching cycle. A cathode of a diode D9 is connected to one of the output windings of the transformer T1, and an anode of the diode D9 is connected to a capacitor C8 and a resistor R19, both of which are also connected to an output ground GND OUT. The anode of the diode D9, the capacitor C8, and the resistor R19 are also connected to an output +Light Color A, which is connected to the Light Color A 114'. The resistor R19 is also connected to a resistor R20. A resistor R21 is connected in parallel across the resistor R20. The resistor R20 and the resistor R21 are also connected to an output −Light Color A, which is connected to the Light Color A 114'. The resistor R20 and the resistor R21 are also connected to an output Light Color A Sense. A cathode of a diode D10 is connected to the other of the output windings of the transformer T1, and an anode of the diode D10 is connected to a resistor R18 and a capacitor C9. The resistor R18 and the capacitor C9 are also connected to the ground output GND OUT, and to an output +Light Color B.

The diode D7, the diode D9, and the diode D10 are coupled to the three output windings of the transformer T1 to rectify the high frequency switching AC voltage and produce a DC output. The capacitor C8 and the capacitor C9 smooth out the rectified DC output and reduce ripple currents in the Light Color A 114' (e.g., which in the example of FIG. 3 is disclosed as a string of white LEDs coupled between the +Light Color A and the −Light Color A outputs) and the Light Color B 116' of FIG. 4, so as to keep the ripple currents below the maximum LED current rating. The resistor R20 and the resistor R21 act as sense resistors to provide feedback of the current flowing through the Light Color A 114' to a load current control circuit, such as but not limited to the load current control circuit 112 of FIG. 1 or a load current control circuit 112' of FIG. 4.

The converter circuit 110' disclosed in FIG. 3 is designed using a flyback power conversion topology utilizing a CCM operating mode of the L6562 Transition-Mode PFC controller manufactured by ST Microelectronics Inc. CCM operation may reduce harmonic distortion in the input current and avoid hard switching of the diode D9 that may, in turn, improve driver efficiency and lower EMI. Higher driver efficiency means that more of the input power to a power supply circuit including the converter circuit 110', such as but not limited to the power supply circuit 104 of FIG. 1, is converted to DC power that gets delivered to a load, such as but not limited to the load 106 of FIG. 1 (e.g., to the Light Color A 114 and the Light Color B 116 of FIG. 1). In some embodiments, the front end circuit 108' of FIG. 2 and the converter circuit 110' of FIG. 3 convert a 120V AC input voltage into dual DC outputs. Table 1 shown below includes approximate input/output ratings for four different example LED-based light sources that may be so configured. In the following example, the Light Color A 114 is a string of white (e.g., 3000K CCT) LEDs and the Light Color B 116 is a string of amber or "sunset" (e.g., 2000K CCT) LEDs.

TABLE 1

| | 75 W Equivalent A19 Lamp | 60 W Equivalent A19 Lamp | 40 W Equivalent A19 Lamp | 60 W Equivalent A15 Lamp |
|---|---|---|---|---|
| Rated Input Power (W) | 14 | 12 | 8 | 8.5 |
| Rated Output Power (W) | 11.5 | 10 | 6 | 6.75 |
| Voltage to Drive Light Color A | 34 | 42 | 30 | 30 |
| Voltage to Drive Light Color B | 32 | 22 | 22 | 22 |

Figure 4:
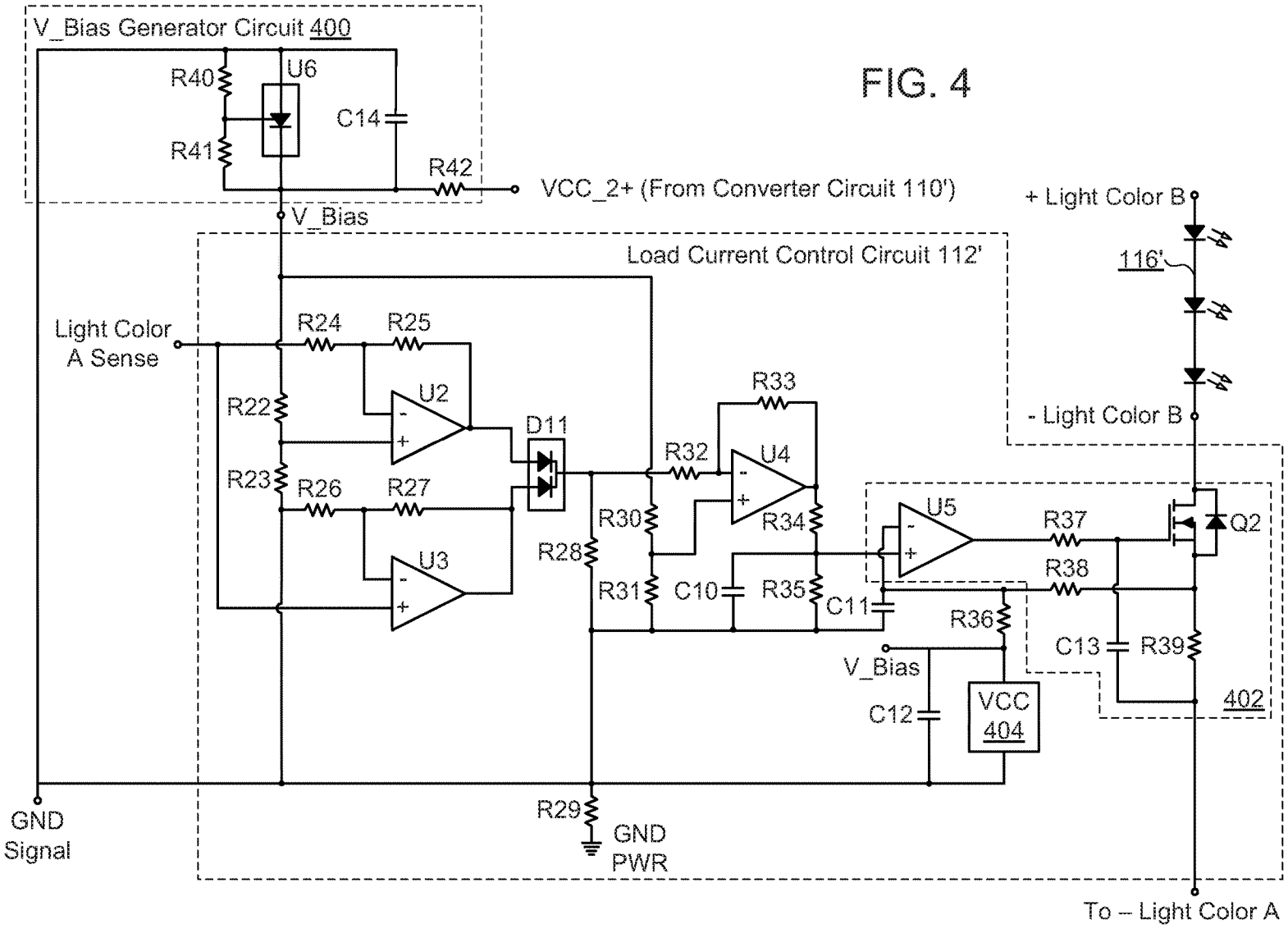
FIG. 4 illustrates a circuit diagram of a load current control circuit coupled to a V-Bias circuit according to embodiments disclosed herein.

FIG. 4 illustrates a circuit diagram of the load current control circuit 112', coupled to a V_Bias generator circuit 400. The operation of the load current control circuit 112' is based on the relationship that the current through a portion of the load, such as but not limited to the Light Color A 114 of FIG. 1 or the Light Color A 114' of FIG. 3, increases when the phase angle increases, and decreases when the phase angle is decreased. In view of this correlation, the current flowing through this portion of the load is deemed to represent the phase angle of a dimmer connected thereto, such as but not limited to the dimmer 102 of FIG. 1, and thus may be employed to control the current through the remainder of the load, such as but not limited to the Light Color B 116 of FIG. 1 or a Light Color B 116' of FIG. 4. In FIG. 4, the Light Color B 116' is a string of amber or "sunset" LEDs coupled between an output +Light Color B and an output −Light Color B.

The V_Bias generator circuit 400 includes a resistor R40 in series with a resistor R41. A capacitor C14 is connected in parallel across the series connection of the resistor R40 and the resistor R41. An integrated circuit U6 is connected to the resistor R40, the resistor R41, and the capacitor C14. A resistor R42 is connected to the capacitor C14, the resistor R41, the integrated circuit U6, and to the output VCC_2+ of the converter circuit 110' of FIG. 3. The resistor R40, the integrated circuit U6, and the capacitor C14 are also connected to a ground signal GND Signal and a VCC voltage source 404 of the load current control circuit 112'. The resistor R40, resistor R41, the resistor R42, the capacitor C14, and the integrated circuit U6 generate an operational voltage at an output V_Bias, which is connected to the load current control circuit 112'. The load current control circuit 112' uses this operational voltage. In some embodiments, the integrated circuit U6 is a low cost precision regulator U6, protected by the resistor R42 and the capacitor C14 and configured using the resistor R40 and the resistor R41 to generate a precision reference voltage. The precision regulator U6 also, in some embodiments, provides different reference voltages to various operational amplifiers U2, U3, U4, and U5 of the load current control circuit 112'. In some embodiments, the load current control circuit 112' is realized using, for example, low cost general purpose OPAMP LM224 manufactured by the Texas Instruments Corporation. Precision OPAMPs may also be utilized. The precision regulator U6 allows the CCT of light output by the Light Color B 116' to be tightly controlled from initialization to normal continuous operation of a power supply circuit, such as but not limited to the power supply circuit 104 of FIG. 1 (e.g., over a zero to forty-five degree Celsius operating temperature range).

The load current control circuit 112' is connected to the output Light Color A Sense of the converter circuit 110' of FIG. 3. More specifically, a resistor R24 and a non-inverting input of an operational amplifier U3 are connected to the output Light Color A Sense of the converter circuit 110' of FIG. 3. The resistor R24 is also connected to a resistor R25 and to an inverting input of an operational amplifier U2. The resistor R25 is also connected to an output of the operational amplifier U2. The non-inverting input of the operational amplifier U2 is connected to a resistor R22, which is also connected to the output V_Bias of the V_Bias generator circuit 400. A resistor R23 is also connected to the resistor R22 and the non-inverting input of the operational amplifier U2. The resistor R23 is also connected to a resistor R26 and to the ground signal GND Signal and to the VCC voltage source 404. The resistor R216 is also connected to a resistor R27 and to a non-inverting input of the operational amplifier U3. The resistor R27 is also connected to an output of the operational amplifier U3. The output of the operational amplifier U2 and the output of the operational amplifier U3 are also connected to a diode D11. A voltage signal proportional to current through the Light Color A 114' (e.g., a voltage at the output Light Color A Sense of the converter circuit 110' of FIG. 3) is fed to the operational amplifier U2 and the operational amplifier U3, in some embodiments directly, and in some embodiments in various voltages that are reduced by the resistors R22, R23, R24, R25, R26, and R27, configured as described above and as shown in FIG. 4. The operational amplifier U3 is thus configured as a non-inverting amplifier and the operational amplifier U2 as an inverting amplifier. The output of the operational amplifier U2 and the operational amplifier U3 are combined using the diode D11, which in some embodiments, is a dual ORing diode.

A resistor R32 is connected to an inverting input of an operational amplifier U4, and to the diode D11. A resistor R33 is also connected to the inverting input of the operational amplifier U4, and to an output of the operational amplifier U4. A resistive divider formed by a series connection of a resistor R30 and a resistor R31 is connected to the output V_Bias of the V_Bias generator circuit 400. A non-inverting input of the operational amplifier U4 is connected between the resistor R30 and the resistor R31. A resistor R28 is connected between the resistor R32 and the resistor R31. A resistor R29 is connected to the resistor R28 and to the ground GND PWR, and thus also the VCC voltage source 404. A resistor R34 is connected to the output of the operational amplifier U4 and to a capacitor C10, which is also connected to the resistor R29. A resistor R35 if connected in parallel to the capacitor C10. A non-inverting input of an operational amplifier U5 is connected to the resistor R34 and the resistor R35. A capacitor C11 is connected between the resistor R35 and an inverting input of an operational amplifier U5. A resistor 36 is connected to the capacitor C11 and the VCC voltage source 404, as well as to a capacitor C12 and the output V_Bias of the V_Bias generator circuit 400. The capacitor C12 is in parallel across the VCC voltage source 404. A resistor R37 is connected to an output of the operational amplifier U5 and to a gate of a transistor Q2, which in some embodiments, as shown in FIG. 4, is an n-channel MOSFET. A drain of the transistor Q2 is connected to an output −Light Color B. The load Light Color B 116' is connected between the output −Light Color B and the output +Light Color B. A source of the transistor Q2 is connected to a resistor R38, which is connected to the resistor R36 and thus to the inverting input of the operational amplifier U5. A resistor R39 is also connected to the source of the transistor Q2 and to the output −Light Color A. A capacitor C13 is connected from the gate of the transistor Q2 to the resistor R39 and to the output −Light Color A.

In some embodiments, the operational amplifiers U2, U3, U4, and U5 are realized as one or more integrated circuits, instead of individual components. For example, in some embodiments, the operational amplifiers U2, U3, U4, and U5 are provided through a single integrated circuit (IC) solution, such as but not limited to an LM224 multi-OPAMP package.

In operation, the output of the operational amplifier U4 goes from high to low, and from low to high, as the phase angle of a dimmer, such as but not limited to the dimmer 102 of FIG. 1, varies from high to low. The resistors R30, R31, R32, and R33 configure the operational amplifier U4 to invert the signal it receives from the dual ORing diode D11. The output of the operational amplifier U4 is then divided by a voltage divider made up of the resistors R34 and R35, and this voltage acts as a reference that sets the amount of current that needs to be passed through the Light Color B 116'. The current through the Light Color B 116' is controlled (e.g., regulated) in some embodiments using a current regulator circuit 402, which includes the operational amplifier U5, the transistor Q2, the resistors R37, R38, and R39, and the capacitor C13. The current profile is set required by adjusting the reference voltages to the operational amplifier U5, the gains of the operational amplifier U5, the values of the resistors R34 and R35 in the voltage divider at the output of the operational amplifier U4, and also using the current sense resistors R20, R21, and R39. These settings may help determine up to what point in phase angle the Light Color A 114' alone may be ON, at what point the Light Color B 116' current may start to ramp up, the rate of ramp up, at what point the Light Color B 116' current may start to ramp down, and the rate of ramp down. By configuring the ramp up, ramp down, rate of ramp up, and rate of ramp down, it may be possible to control the current profile in the Light Color B 116' as required to produce a CCT dimming that results in a light output that is similar, and in some embodiments substantially similar, to an incandescent lamp. In some embodiments, the transistor Q2 is operated in linear mode and the voltage of the winding driving the Light Color B 116' is set to minimize power loss. The resistors R36 and R38 and the capacitor C11 are used to nullify (e.g., filter) any effect of previous stages that may drive current through the Light Color B 116' at high end. The VCC voltage source 404 is configured to provide an operating voltage (VCC) to at least the operational amplifiers U2, U3, U4, and U5. In some embodiments, and as shown in FIG. 4, a junction between the VCC voltage source 404, the resistor R36, and the capacitor C12 is coupled to the output V_Bias of the V_Bias generator circuit 400. The resistor R29 is used, in some embodiments, to connect the ground signal GND Signal and the ground GND PWR at a single point. The capacitor C12 acts as a filter across power and ground pins of the operational amplifier U5.

Figure 5:
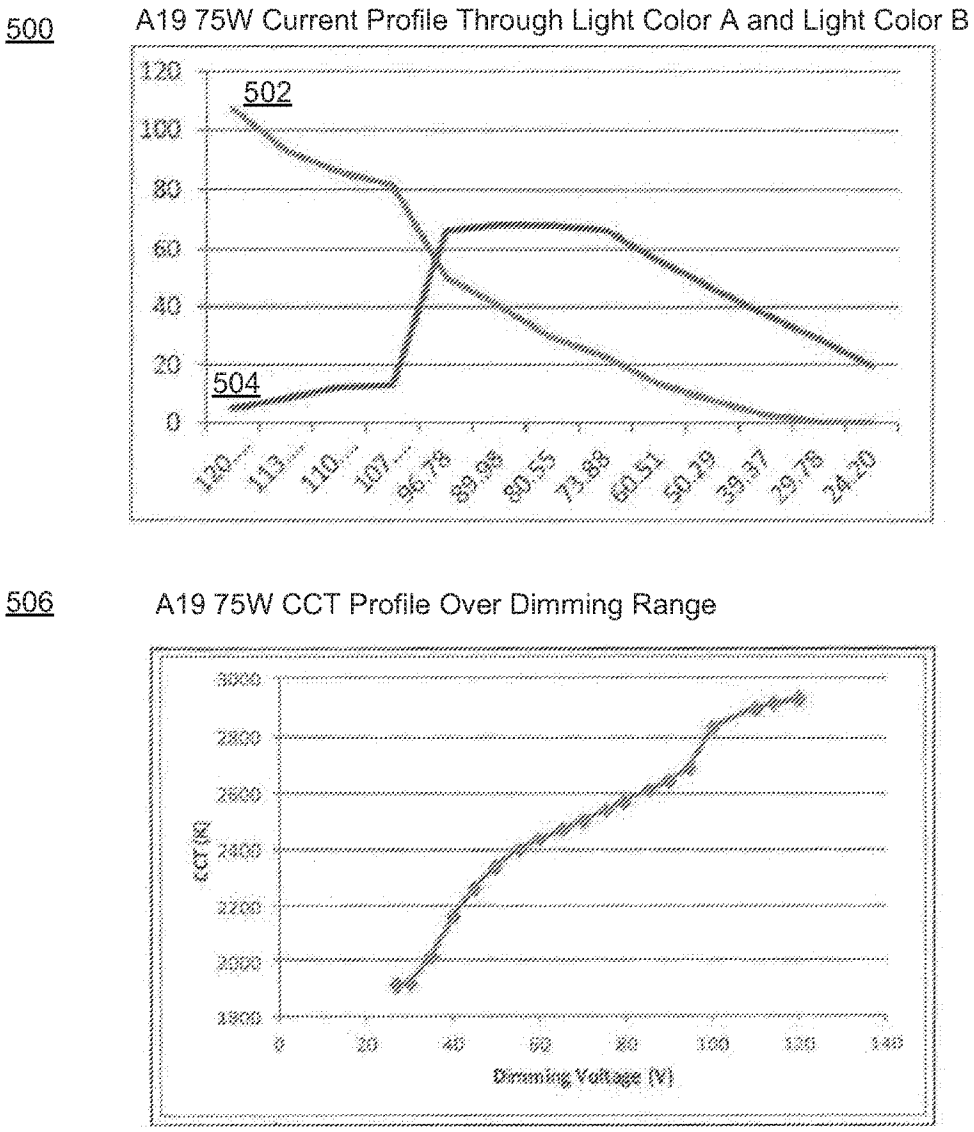
FIG. 5 illustrates graphs of current profile and correlated color temperature for a system configured to emit light similar to that of an A19 75 W incandescent lamp during dimming according to embodiments disclosed herein.

FIG. 5 illustrates graphs of current profile and correlated color temperature for a system configured to emit light similar to that of an A19 75 W incandescent lamp during dimming according to embodiments disclosed herein. A graph 500 in FIG. 5 shows an example relationship between load current in amps and dimmer voltage in volts. As the dimmer voltage is reduced from 120V towards zero, the current in Light Color A (such as Light Color A 114 or Light Color A 114'), as illustrated by a representation 502, is gradually reduced, while the current in Light Color B (such as Light Color B 116 or Light Color B 116'), as illustrated by a representation 504, is gradually increased. At approximately 108V, the current in Light Color A, as shown by the representation 502, decreases substantially, while the current in Light Color B, as shown by the representation 504, increases substantially. This behavior increases the contribution of Light Color B to the combined light emissions to alter the intensity and color of the load (i.e., the light source) to replicate the behavior of an incandescent light source controlled by a dimmer set at the same voltage. As the dimmer voltage continues to be reduced, the current in Light Color B, as shown by the representation 504, is controlled to be reduced in a manner distinct from the current in Light Color A, as shown by the representation 502, to replicate dimmed incandescent light. A graph 506 in FIG. 5 shows an example relationship between the CCT in Kelvin of light and dimming voltage in volts (V). The graph 506 illustrates that as the dimming voltage is increased, the output of the combined Light Color A and Light Color B, as measured in Kelvin, increases in a manner that closely resembles the light output of an incandescent light source.

Figure 6:
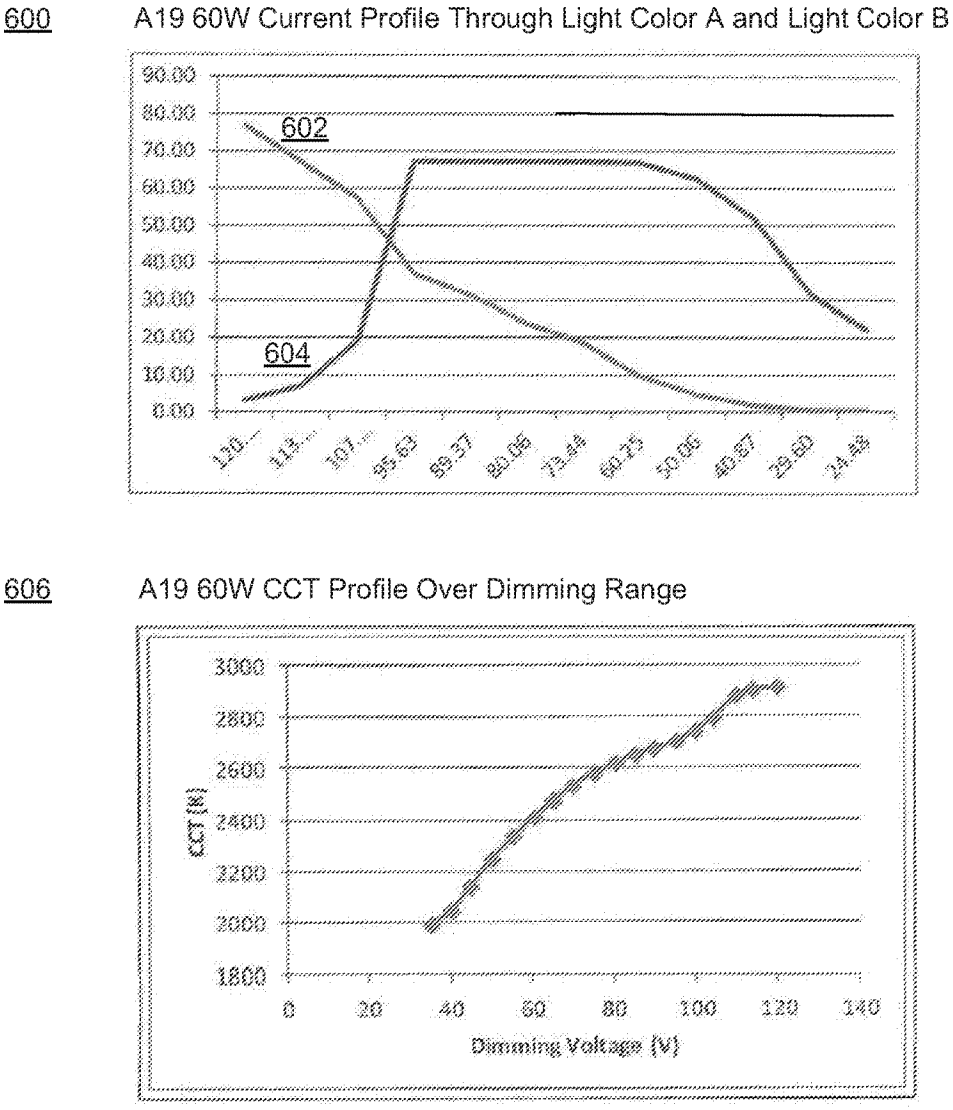
FIG. 6 illustrates graphs of current profile and correlated color temperature for a system configured to emit light similar to that of an A19 60 W incandescent lamp during dimming according to embodiments disclosed herein.

FIG. 6 illustrates graphs of current profile and correlated color temperature for a system configured to emit light similar to that of an A19 60 W incandescent lamp during dimming according to embodiments disclosed herein. A graph 600 in FIG. 6 shows an example relationship between load current in amps and dimmer voltage in volts. As the dimmer voltage is reduced from 120V towards zero, the current in Light Color A (such as Light Color A 114 or Light Color A 114'), as illustrated by a representation 602, is gradually reduced, while the current in Light Color B (such as Light Color B 116 or Light Color B 116'), as illustrated by a representation 604, is gradually increased. At approximately 108V, the current in Light Color A, as shown by the representation 602, decreases substantially, while the current in Light Color B, as shown the representation 604, increases substantially. This behavior increases the contribution of Light Color B to the combined light emissions to alter the intensity and color of the light source to replicate the behavior of an incandescent light source controlled by a dimmer set at the same voltage. As the dimmer voltage continues to be reduced, the current through Light Color B, as shown by the representation 604, is controlled to be reduced in a manner distinct from the current through Light Color A, as shown by the representation 602, to replicate light emitted by a dimmed incandescent light source. A graph 606 in FIG. 6 shows an example relationship between the CCT in Kelvin and dimming voltage in volts. The graph 606 illustrates that as the dimming voltage is increased, the output of the load including Light Color A and Light Color B increases in a manner that closely resembles the light output of an incandescent light source.

Figure 7:
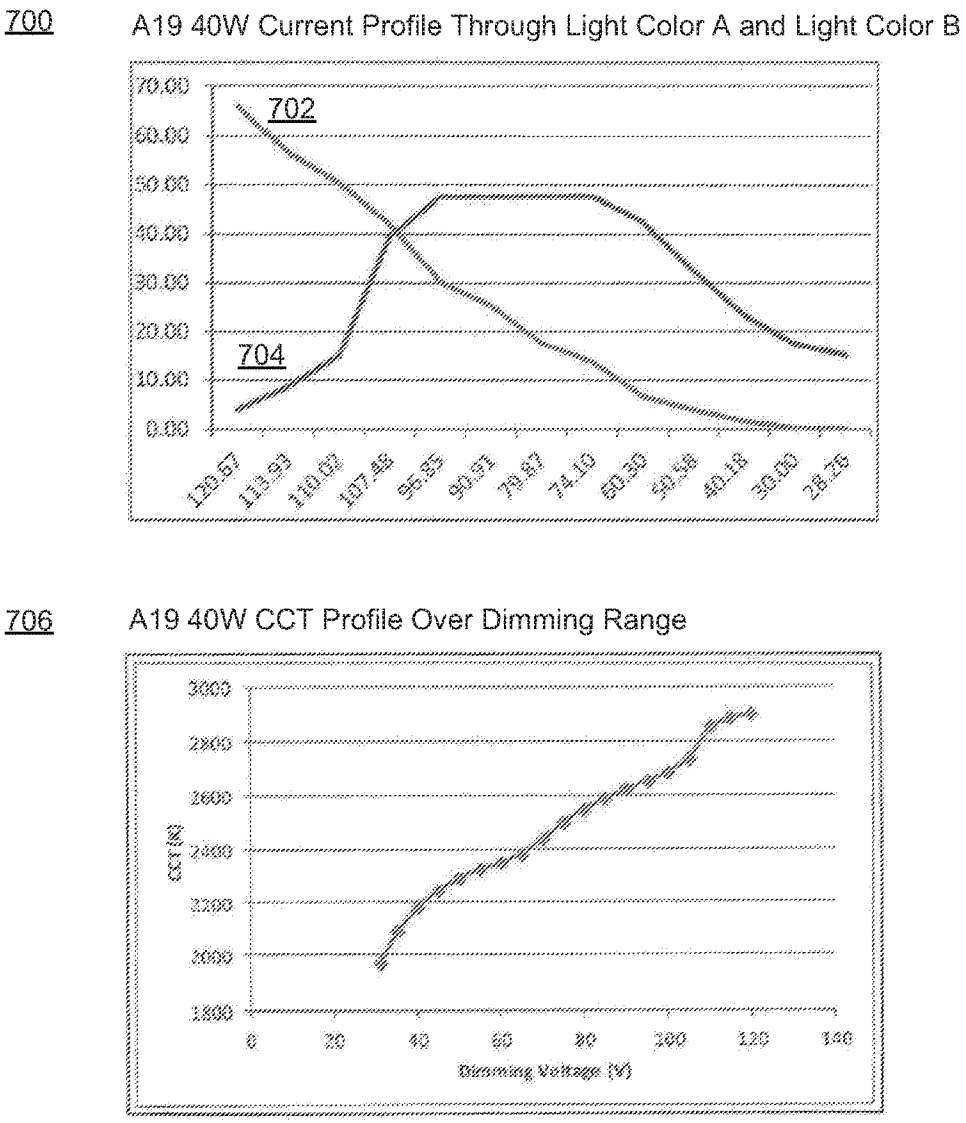
FIG. 7 illustrates graphs of current profile and correlated color temperature for a system configured to emit light similar to that of an A19 40 W incandescent lamp during dimming according to embodiments disclosed herein.

FIG. 7 illustrates graphs of current profile and correlated color temperature for a system configured to emit light similar to that of an A19 40 W incandescent lamp during dimming according to embodiments disclosed herein. A graph 700 in FIG. 7 shows an example relationship between load current in amps and dimmer voltage in volts. As the dimmer voltage is reduced from 120V towards zero, the current in Light Color A (such as Light Color A 114 or Light Color A 114'), as illustrated by a representation 702, is gradually reduced, while the current in Light Color B (such as Light Color B 116 or Light Color B 116'), as illustrated by a representation 704, is gradually increased. At approximately 108V, the current through Light Color B, as shown by the representation 704, increases substantially. This behavior increases the contribution of Light Color B to the light emissions of the system including a load including Light Color A and Light Color B, to alter the intensity and color of the load to replicate the behavior of an incandescent light source controlled by a dimmer set at the same voltage. As the dimmer voltage continues to be reduced, the current through Light Color B, as shown by the representation 704, is controlled to be reduced in a manner distinct from current through Light Color A, as shown by the representation 702, to replicate the light output of a dimmed incandescent light source. A graph 706 in FIG. 7 shows an example relationship between the CCT in Kelvin and dimming voltage in volts. The graph 706 illustrates that as the dimming voltage is increased, the output of the load including Light Color A and Light Color B increases in a manner that closely resembles the light output of an incandescent light source.

Figure 8:
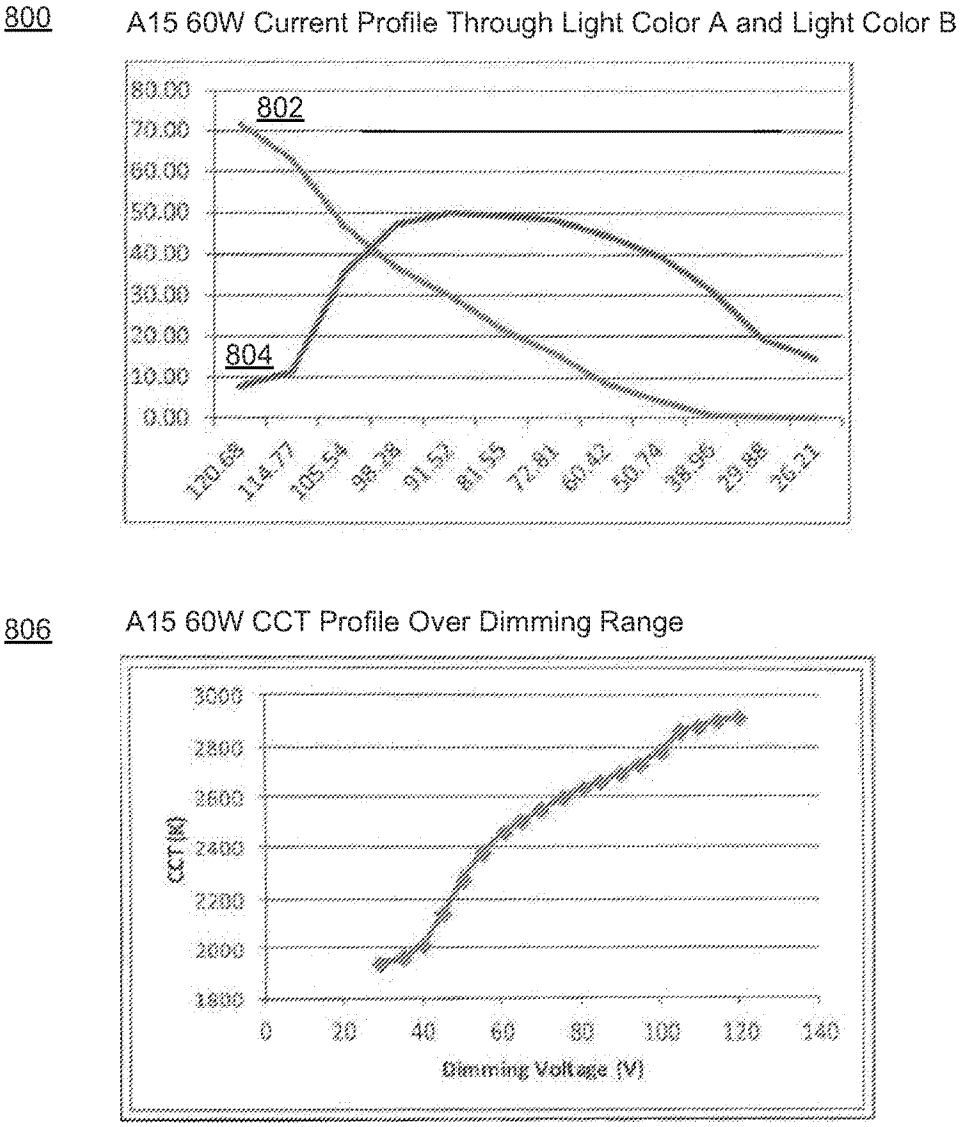
FIG. 8 illustrates graphs of current profile and correlated color temperature for a system configured to emit light similar to that of an A16 60 W incandescent lamp during dimming according to embodiments disclosed herein.

FIG. 8 illustrates graphs of current profile and correlated color temperature for a system configured to emit light similar to that of an A16 60 W incandescent lamp during dimming according to embodiments disclosed herein. A graph 800 in FIG. 8 shows an example relationship between load current in amps and dimmer voltage in volts. As the dimmer voltage is reduced from 120V to zero, the current in Light Color A (such as Light Color A 114 or Light Color A 114'), as illustrated by a representation 802, is gradually reduced, while the current in Light Color B (such as Light Color B 116 or Light Color B 116'), as illustrated by a representation 804, is gradually increased. At approximately 108V, the current through Light Color B, as shown by the representation 804, increases substantially. This behavior increases the contribution of Light Color B to the light emissions of the system including a load including Light Color A and Light Color B, to alter the intensity and color of the load to replicate the behavior of an incandescent light source controlled by a dimmer set at the same voltage. As the dimmer voltage continues to be reduced, the current through Light Color B, as shown by the representation 804, is controlled to be reduced in a manner distinct from current through Light Color A, as shown by the representation 802, to replicate the light output of a dimmed incandescent light source. A graph 806 in FIG. 8 shows an example relationship between the CCT in Kelvin and dimming voltage in volts. The graph 806 illustrates that as the dimming voltage is increased, the output of the load including Light Color A and Light Color B increases in a manner that closely resembles the light output of an incandescent light source.

Figure 9:
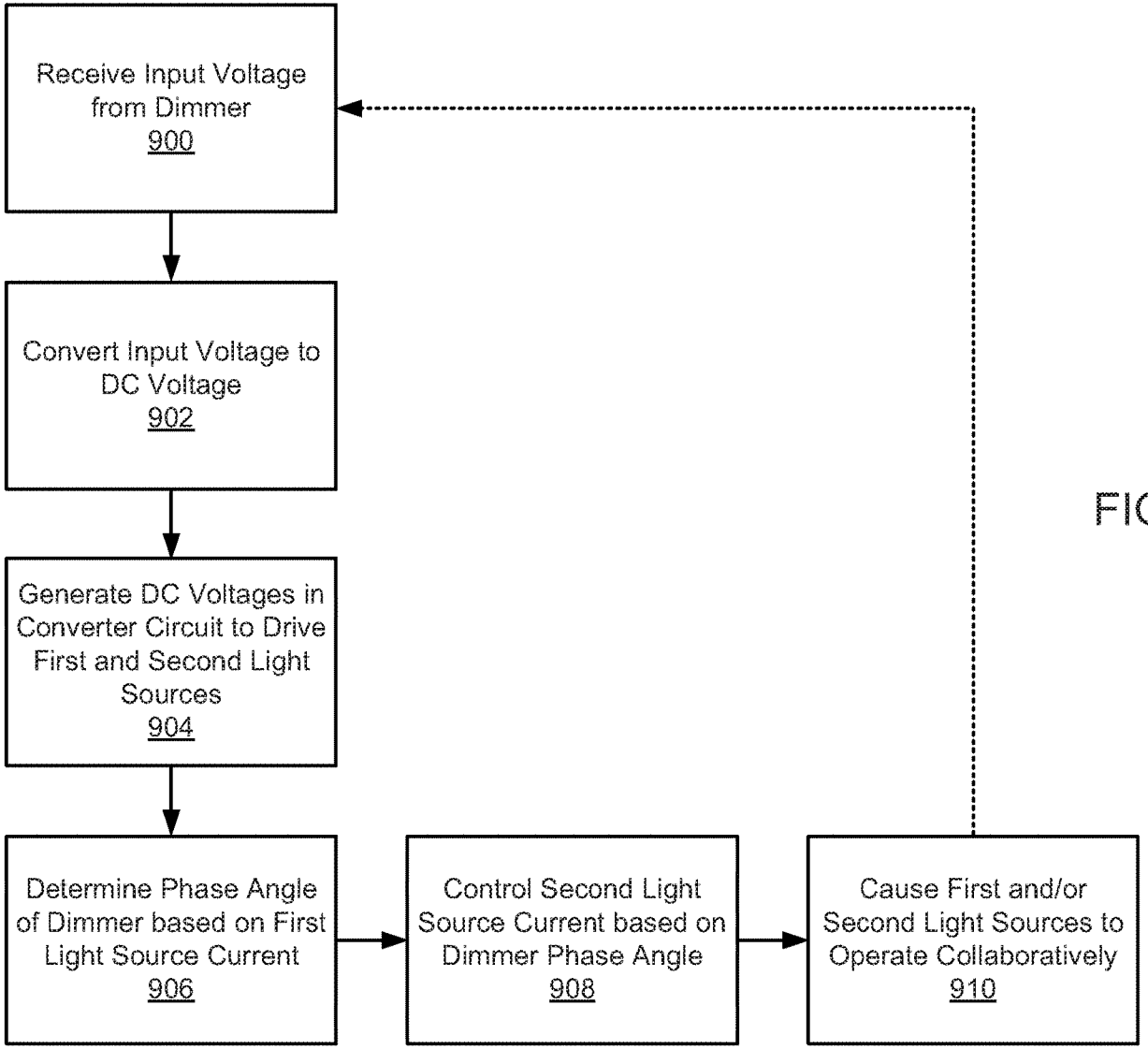
FIG. 9 illustrates a flowchart of operations to control light color temperature during dimming according to embodiments disclosed herein.

A flowchart of a method 999 of operations to control light color temperature during dimming according to embodiments disclosed herein is depicted in FIG. 9. The rectangular elements are herein denoted "processing blocks" and represent computer software instructions, or groups of instructions, and "decision blocks" and represent computer software instructions, or groups of instructions, which affect the execution of the computer software instructions represented by the processing blocks. Alternatively, the processing and decision blocks represent steps performed by functionally equivalent circuits such as a digital signal processor circuit or an application specific integrated circuit (ASIC). The flowchart does not depict the syntax of any particular programming language. Rather, the flowchart illustrates the functional information one of ordinary skill in the art requires to fabricate circuits or to generate computer software to perform the processing required in accordance with the present invention. It should be noted that many routine program elements, such as initialization of loops and variables and the use of temporary variables, are not shown. It will be appreciated by those of ordinary skill in the art that unless otherwise indicated herein, the particular sequence of steps described is illustrative only and can be varied without departing from the spirit of the invention. Thus, unless otherwise stated, the steps described below are unordered meaning that, when possible, the steps can be performed in any convenient or desirable order.

Further, while FIG. 9 illustrates various operations, it is to be understood that not all of the operations depicted in FIG. 9 are necessary for other embodiments to function. Indeed, it is fully contemplated herein that in other embodiments of the present disclosure, the operations depicted in FIG. 9, and/or other operations described herein, may be combined in a manner not specifically shown in any of the drawings, but still fully consistent with the present disclosure. Thus, claims directed to features and/or operations that are not exactly shown in one drawing are deemed within the scope and content of the present disclosure.

In FIG. 9, in operation 900, an input voltage is received from a dimmer. In some embodiments, the input voltage is an AC voltage received from a phase-cut dimmer. The input voltage is converted to a DC voltage in operation 902. In operation 904, a first DC voltage is generated to drive a first light source and a second DC voltage is generated to drive a second light source. In operation 906, a phase angle for the phase-cut dimmer is determined based on determining a current flowing through the first light source. For example, a sense voltage proportional to the current flowing through the first light source is provided to a load current control circuit. The load current control circuit then controls current flowing through the second light source based on the dimmer phase angle (e.g., based on the sense voltage) in operation 908. In operation 910, the previously performed operations 900 to 908 cause the first and second light sources to operate collaboratively (e.g., to emit light that replicates light emitted from an incandescent light source controlled by a dimmer configured at the light control setting). Operation 910, in some embodiments, is followed by a return to operation 900 to prepare to receive a new input voltage from the dimmer.

The methods and systems described herein are not limited to a particular hardware or software configuration, and may find applicability in many computing or processing environments. The methods and systems may be implemented in hardware or software, or a combination of hardware and software. The methods and systems may be implemented in one or more computer programs, where a computer program may be understood to include one or more processor executable instructions. The computer program(s) may execute on one or more programmable processors, and may be stored on one or more storage medium readable by the processor (including volatile and non-volatile memory and/or storage elements), one or more input devices, and/or one or more output devices. The processor thus may access one or more input devices to obtain input data, and may access one or more output devices to communicate output data. The input and/or output devices may include one or more of the following: Random Access Memory (RAM), Redundant Array of Independent Disks (RAID), floppy drive, CD, DVD, magnetic disk, internal hard drive, external hard drive, memory stick, or other storage device capable of being accessed by a processor as provided herein, where such aforementioned examples are not exhaustive, and are for illustration and not limitation.

The computer program(s) may be implemented using one or more high level procedural or object-oriented programming languages to communicate with a computer system; however, the program(s) may be implemented in assembly or machine language, if desired. The language may be compiled or interpreted.

As provided herein, the processor(s) may thus be embedded in one or more devices that may be operated independently or together in a networked environment, where the network may include, for example, a Local Area Network (LAN), wide area network (WAN), and/or may include an intranet and/or the internet and/or another network. The network(s) may be wired or wireless or a combination thereof and may use one or more communications protocols to facilitate communications between the different processors. The processors may be configured for distributed processing and may utilize, in some embodiments, a client-server model as needed. Accordingly, the methods and systems may utilize multiple processors and/or processor devices, and the processor instructions may be divided amongst such single- or multiple-processor/devices.

The device(s) or computer systems that integrate with the processor(s) may include, for example, a personal computer (s), workstation(s) (e.g., Sun, HP), personal digital assistant (s) (PDA(s)), handheld device(s) such as cellular telephone (s) or smart cellphone(s), laptop(s), handheld computer(s), or another device(s) capable of being integrated with a processor(s) that may operate as provided herein. Accordingly, the devices provided herein are not exhaustive and are provided for illustration and not limitation.

References to "a microprocessor" and "a processor", or "the microprocessor" and "the processor," may be understood to include one or more microprocessors that may communicate in a stand-alone and/or a distributed environment(s), and may thus be configured to communicate via wired or wireless communications with other processors, where such one or more processor may be configured to operate on one or more processor-controlled devices that may be similar or different devices. Use of such "microprocessor" or "processor" terminology may thus also be understood to include a central processing unit, an arithmetic logic unit, an application-specific integrated circuit (IC), and/or a task engine, with such examples provided for illustration and not limitation.

Furthermore, references to memory, unless otherwise specified, may include one or more processor-readable and accessible memory elements and/or components that may be internal to the processor-controlled device, external to the processor-controlled device, and/or may be accessed via a wired or wireless network using a variety of communications protocols, and unless otherwise specified, may be arranged to include a combination of external and internal memory devices, where such memory may be contiguous and/or partitioned based on the application. Accordingly, references to a database may be understood to include one or more memory associations, where such references may include commercially available database products (e.g., SQL, Informix, Oracle) and also proprietary databases, and may also include other structures for associating memory such as links, queues, graphs, trees, with such structures provided for illustration and not limitation.

References to a network, unless provided otherwise, may include one or more intranets and/or the internet. References herein to microprocessor instructions or microprocessor-executable instructions, in accordance with the above, may be understood to include programmable hardware.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A system, comprising:

a load including a first light source and a second light source; and a power supply to drive the load, the power supply comprising:

a front end circuit to generate a direct current voltage based on an input voltage received from a dimmer;

a converter circuit to generate a first voltage to drive the first light source and a second voltage to drive the second light source based on the direct current voltage; and a load current control circuit to control a current flowing through the second light source based on a light control setting configured in the dimmer, the load current control circuit being configured to control the current flowing through the second light source to cause the first light source and the second light source to operate collaboratively in a dimming function of the light control setting, wherein the load current control circuit is configured to control the current flowing through the second light source based on a sense voltage proportional to a current flowing solely through the first light source, the sense voltage proportional to the current flowing solely through the first light source being determined from at least one sense resistor that is in communication with only the first light source, wherein the load current control circuit comprises a current regulator circuit to control the current flowing through the second light source, wherein the current regulator circuit comprises an operational amplifier, a first resistor coupled to an output of the operational amplifier, a transistor having a gate coupled to the first resistor and a drain coupled to an output of the second light source, a second resistor coupled between a source of the transistor and an input to the operational amplifier, a current sense resistor coupled between the source of the transistor and a negative terminal of the first light source, and a capacitor coupled between the first resistor and the sense resistor.

2. The system of claim 1, wherein the converter circuit includes a direct current voltage to direct current voltage converter based on a continuous-conduction mode flyback topology.

3. The system of claim 1, wherein the first light source comprises a solid state light source that emits light at a first color temperature and wherein the second light source comprises a solid state light source that emits light at a second color temperature.

4. The system of claim 3, wherein the first color temperature has a higher correlated color temperature than the second color temperature.

5. The system of claim 3, wherein the system produces light similar to light emitted by an incandescent light source controlled by the dimmer configured at the light control setting.

6. The system of claim 1, wherein the dimmer is a phase-cut dimmer, and wherein the sense voltage represents the phase angle of the phase-cut dimmer.

7. The system of claim 1, wherein the operational amplifier is configured to receive a reference voltage corresponding to the amount of current to be allowed to flow through the second light source.

8. A power supply, comprising:

a front end circuit to generate a direct current voltage based on an input voltage;

a converter circuit to utilize the direct current voltage to generate a first voltage to drive a first light source, a second voltage to drive a second light source, and a sense voltage proportional to a current flowing through the first light source; and a load current control circuit to control a current flowing through the second light source based at least on the sense voltage, the load current control circuit being configured to control the current flowing through the second light source to cause the first light source and the second light source to operate collaboratively in a dimming function, wherein the load current control circuit is configured to control the current flowing through the second light source based on the sense voltage proportional to a current flowing solely through the first light source, the sense voltage proportional to the current flowing solely through the first light source being determined from at least one sense resistor that is in communication with only the first light source, wherein the load current control circuit comprises a current regulator circuit to control the current flowing through the second light source, the current regulator circuit comprising an operational amplifier, a first resistor coupled to an output of the operational amplifier, a transistor having a gate coupled to the first resistor and a drain coupled to an output of the second light source, a second resistor coupled between a source of the transistor and an input to the operational amplifier, a current sense resistor coupled between the source of the transistor and a negative terminal of the first light source, and a capacitor coupled between the first resistor and the sense resistor.

9. The power supply of claim 8, wherein the input voltage is received in the front end circuit from a phase-cut dimmer, and wherein the sense voltage represents the phase angle of the phase-cut dimmer.

10. The power supply circuit according to claim 8, wherein the operational amplifier is configured to receive a reference voltage corresponding to the amount of current to be allowed to flow through the second light source.

11. A method to control light color temperature for at least two light sources, comprising:

receiving an input voltage from a dimmer;

converting the input voltage to a direct current voltage;

generating a first voltage to drive a first light source and a second voltage to drive a second light source based on the direct current voltage; and controlling a current flowing through the second light source based on a light control setting configured in the dimmer, wherein said controlling the current comprises a load current control circuit configured to control the current flowing through the second light source to cause the first light source and the second light source to operate collaboratively in a dimming function, wherein the load current control circuit is configured to control the current flowing through the second light source based on a sense voltage proportional to a current flowing solely through the first light source, the sense voltage proportional to the current flowing solely through the first light source being determined from at least one sense resistor that is in communication with only the first light source, wherein the load current control circuit comprises a current regulator circuit to control the current flowing through the second light source, the current regulator circuit comprising an operational amplifier, a first resistor coupled to an output of the operational amplifier, a transistor having a gate coupled to the first resistor and a drain coupled to an output of the second light source, a second resistor coupled between a source of the transistor and an input to the operational amplifier, a current sense resistor coupled between the source of the transistor and a negative terminal of the first light source, and a capacitor coupled between the first resistor and the sense resistor.

12. The method of claim 11, wherein the dimmer is a phase-cut dimmer and the control setting is a phase angle of the phase-cut dimmer.

13. The method of claim 11, wherein controlling the current flowing through the second light source comprises utilizing an operational amplifier configured to receive a reference voltage corresponding to the amount of current to be allowed to flow through the second light source to control a transistor to control the current flowing through the second light source.

14. The method of claim 11, wherein the method produces light similar to light emitted by an incandescent light source controlled by the dimmer configured at the light control setting.

* * * * *